US010947089B2

(12) United States Patent
Waisanen

(10) Patent No.: US 10,947,089 B2
(45) Date of Patent: Mar. 16, 2021

(54) BOTTOM BLOCK ASSEMBLY

(71) Applicant: Konecranes Global Corporation, Hyvinkää (FI)

(72) Inventor: Steven K. Waisanen, Big Bend, WI (US)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 192 days.

(21) Appl. No.: 16/136,148

(22) Filed: Sep. 19, 2018

(65) Prior Publication Data

US 2020/0087120 A1 Mar. 19, 2020

(51) Int. Cl.

| | |
|---|---|
| ***B66C 1/34*** | (2006.01) |
| ***B66C 15/02*** | (2006.01) |
| ***B66C 17/00*** | (2006.01) |
| ***B66D 3/06*** | (2006.01) |

(52) U.S. Cl.

CPC ..... *B66C 1/34* (2013.01); *B66C 15/02* (2013.01); *B66C 17/00* (2013.01); *B66D 3/06* (2013.01)

(58) Field of Classification Search

CPC ..... B66D 3/06; B66D 3/08; B66D 2700/028; B66C 1/34

See application file for complete search history.

(56) References Cited

U.S. PATENT DOCUMENTS 462,501 A * 11/1891 McCabe ..... B66D 3/06 254/399
519,984 A * 5/1894 Browne ..... B66D 3/06 254/403
1,435,953 A * 11/1922 Boykin, Jr. ..... B66D 3/06 254/401
1,713,586 A * 5/1929 Wright ..... B66D 3/06 254/404

(Continued)

FOREIGN PATENT DOCUMENTS

DE 2853404 A1 6/1980

OTHER PUBLICATIONS

Extended European Search Report for Application No. 19198060.6 dated Feb. 13, 2020 (7 pages).

*Primary Examiner* — Michael R Mansen
*Assistant Examiner* — Juan J Campos, Jr.
(74) *Attorney, Agent, or Firm* — Michael Best & Friedrich

(57) ABSTRACT

A bottom block assembly includes a bottom block defining a cavity and at least one opening passing through a portion of the bottom block. The assembly further includes a plurality of sheaves disposed at least partially within the cavity, each sheave having a central opening. The assembly further includes a sheave pin passing through the at least one opening in the bottom block and the central openings in the sheaves to rotatably couple the plurality of sheaves to the bottom block. The assembly further includes a plurality of captivating frame assemblies to be coupled to the plurality of sheaves, each of the plurality of captivating frame assemblies including a housing and a plurality of rollers rotatably mounted to the housing. Each captivating frame assembly is associated with a corresponding one of the sheaves. The assembly further includes a plurality of wires for coupling the plurality of captivating frame assemblies to the plurality of sheaves. Each wire is reeved around one of the sheaves and reeved through the corresponding captivating frame assembly.

20 Claims, 8 Drawing Sheets

(56) References Cited

U.S. PATENT DOCUMENTS

| | | | | |
|---|---|---|---|---|
| 2,672,320 | A * | 3/1954 | Minor | B66D 3/06 254/404 |
| 3,050,286 | A * | 8/1962 | Seamans | B66D 3/04 254/401 |
| 3,179,376 | A * | 4/1965 | Botten | B66D 3/06 254/401 |
| 3,210,115 | A * | 10/1965 | Graham | B66C 1/34 294/82.15 |
| 3,286,863 | A * | 11/1966 | Thompson | B66C 3/12 414/624 |
| 6,405,833 | B1 * | 6/2002 | Baranda | B66D 3/08 187/251 |
| 8,438,713 | B2 | 5/2013 | Waisanen | |
| 9,950,904 | B2 * | 4/2018 | Kosuga | B66D 1/36 |
| 2004/0084917 | A1 * | 5/2004 | Zollondz | B66C 1/34 294/82.15 |
| 2007/0090658 | A1 * | 4/2007 | Frommelt | B66C 1/34 294/82.15 |
| 2010/0237641 | A1 | 9/2010 | Drent et al. | |
| 2014/0017049 | A1 | 1/2014 | Coogan et al. | |

* cited by examiner

BOTTOM BLOCK ASSEMBLY

FIELD OF INVENTION

The present invention relates to a bottom block assembly, for example for use with a crane assembly (e.g., polar crane, ladle crane, cask transport crane, etc.), or with various other lifting systems that utilize a bottom block for lifting purposes.

BACKGROUND

Bottom blocks are commonly used to raise and lower loads in a wide variety of applications, including but not limited to applications in the nuclear industry, steel industry, etc. The bottom blocks commonly include sheaves having bores with bearings or bushings mounted in the bores, as well as a sheave pin that passes through bearings or bushings. Wires ropes or chains are reeved to the sheaves. As a part of long term planned maintenance of the bottom block, the bearings or bushings, and/or the sheave pin, will require periodic inspection and/or replacement, due to wear. On current machines, this involves unreaving all of the wire ropes or chains, separating the sheaves, replacing for example the bearings or bushings or sheave pin, and then re-reaving all of the wire ropes or chains. On high production cranes, or critical-to-operation cranes, however, the cranes must remain in service for extensive amounts of time, and any down time is highly undesired. To take these type of cranes out of service and to perform inspection and/or repair costs the crane owner substantial amounts of money and critical path time due to the long amounts of down time required to perform the work. Accordingly, there is a need for a bottom block assembly that reduces down time, and allows a crane owner to quickly and efficiently inspect and/or replace components such as the bearing or bushing or sheave pin.

SUMMARY

In one construction, the invention provides a bottom block assembly. The bottom block assembly includes a bottom block defining a cavity and at least one opening passing through a portion of the bottom block. The assembly further includes a plurality of sheaves disposed at least partially within the cavity, each sheave having a central opening. The assembly further includes a sheave pin passing through at least one opening in the bottom block and the central openings in the sheaves to rotatably couple the plurality of sheaves to the bottom block. The assembly further includes a plurality of captivating frame assemblies to be coupled to the plurality of sheaves, each of the plurality of captivating frame assemblies including a housing and a plurality of rollers rotatably mounted to the housing. Each captivating frame assembly is associated with a corresponding one of the sheaves. The assembly further includes a plurality of wire ropes or chains for coupling the plurality of captivating frame assemblies to the plurality of sheaves. Each rope or chain is reeved around one of the sheaves and reeved through the corresponding captivating frame assembly.

In another construction, the invention provides a method of performing inspection and/or maintenance on a bottom block assembly. The bottom block assembly includes a bottom block, a plurality of sheaves rotatably coupled to the bottom block via a sheave pin, a plurality of captivating frame assemblies coupled together via a key rod, and a plurality of wire ropes or chains coupling each captivating frame assembly to a corresponding one of the sheaves, wherein each sheave includes a bore and a bearing or bushing mounted in the bore. The method includes the steps of: (a) supporting the bottom block assembly in a support stand; (b) in response to step (a), removing the sheave pin to separate the plurality of sheaves from the bottom block; (c) in response to step (b), removing the key rod from a key slot in each of the plurality of captivating frame assemblies; and (d) in response to steps (b) and (c), separating the plurality of captivating frame assemblies to gain access to one of the plurality of sheaves with bearing or bushings.

In another construction, the invention provides a bottom block assembly. The bottom block assembly includes a plurality of sheaves with bearings or bushings, and a plurality of captivating frame assemblies to be coupled with the plurality of sheaves. Each of the plurality of captivating frame assemblies includes a housing and a roller rotatably mounted within the housing. Each captivating frame assembly is associated with a corresponding sheave. The assembly further includes a plurality of wire ropes or chains coupling the plurality of captivating frame assemblies to the plurality of sheaves. Each wire rope or chain is reeved around one of the sheaves and reeved through the corresponding captivating frame assembly. Each of the rollers is rotatably engaged with one of the wire ropes or chains, and each captivating frame assembly further includes a biasing arm coupled to the roller biasing the roller into engagement with the wire rope or chain.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
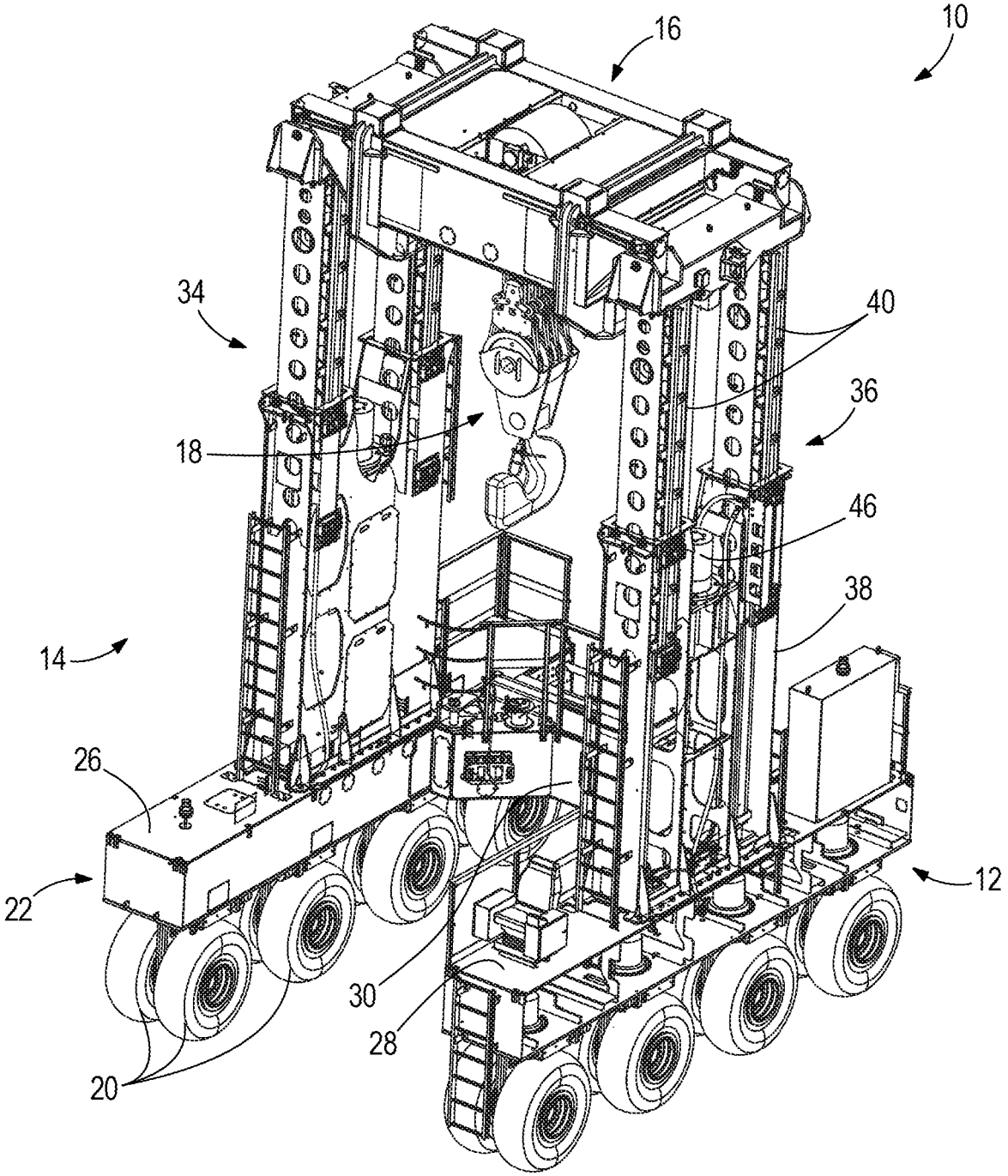
FIG. 1 is a front perspective view of a cask transport assembly according to one construction, illustrating a leg portion of the assembly system shown in cross section and a bottom block assembly in a first, retracted position.
Figure 2:
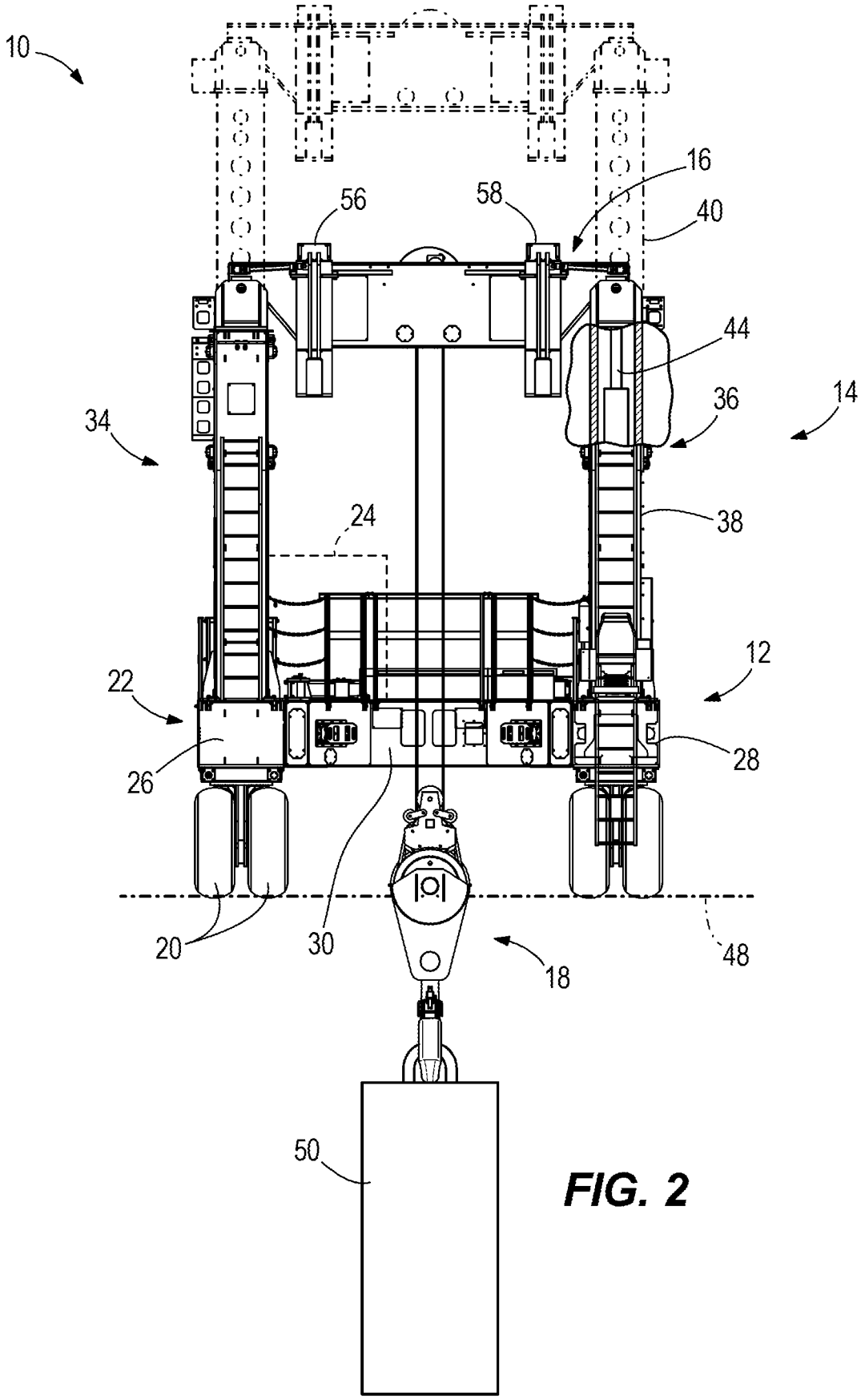
FIG. 2 is a front view of the cask transport assembly with the bottom block assembly in a second, extended position.

FIG. 1 illustrates a cask transport assembly 10 including a support assembly 12, a tower 14, an upper beam assembly 16 and a bottom block assembly 18. The support assembly 12 includes wheels 20 (e.g., sixteen in the illustrated construction), a U-shaped frame 22 and a prime mover 24 (FIG. 2). The frame 22 includes first and second legs 26, 28 and a middle portion 30 extending between the two legs 26, 28. Each of the legs 26, 28 is supported on eight of the plurality of wheels 20. The prime mover 24 is supported on the middle portion 30. The prime mover 24 is part of a hydraulic system that is operable to drive the wheels 20 and thereby move the U-shaped frame 22, as well as actuate the various hydraulic cylinders described herein. Other arrangements and configurations are possible, and the illustrated construction is given by way of example only.

As shown in FIG. 1, the tower 14 includes a first side 34 and a second side 36, which is substantially a mirror-image of the first side 34. The first side 34 is coupled to the first leg 26, while the second side 36 is coupled to the second leg 28. Because the first side 34 is a substantial mirror-image of the second side 36, only the second side 36 will be discussed in detail; however, the discussion of the second side 36 applies equally to the first side 34. A portion of the second side 36 is shown in cross section.

With reference to FIGS. 1 and 2, the second side 36 is shown in greater detail. The second side 36 includes a base portion 38, a single pair of moving frames 40, a single pair of hydraulic cylinders 44 (only one of which is shown), and a safety catch 46. The safety catch 46 is included to catch the upper beam assembly 16 in the event of hydraulic pressure loss. The base portion 38 is substantially fixed to the second side 36 of the frame 22 and extends upwardly therefrom. The base portion 38 is a substantially hollow rectangular frame.

The first pair of moving frames 40 are coupled to the base portion 38 and telescope vertically in and out of the substantially hollow rectangular frame defined by the base portion 38. The first pair of moving frames 40 are substantially hollow rectangular frames. The first pair of hydraulic cylinders 44 are coupled to the base portion 38 at one end and to the first pair of moving frames 40 at the other end. The first pair of hydraulic cylinders 44 are heavy duty double-acting hydraulic cylinders and are operable to move the first pair of moving frames 40 vertically both up and down. The first pair of hydraulic cylinders 44 are movable between a fully extended position (as depicted by phantom lines in FIG. 2) and a fully retracted position (as depicted by solid lines in FIG. 2).

With reference to FIG. 2, the bottom block assembly 18 is below the ground or ground surface 48, and is coupled to a multi-purpose canister 50. As shown, the tower 14 is fully retracted and the bottom block assembly 18 is fully extended, so that the bottom block assembly 18 is as far below the ground surface 48 as possible. The bottom block assembly 18 is moveable between a retracted position (FIG. 1) and an extended position (FIG. 2).

Figure 3:
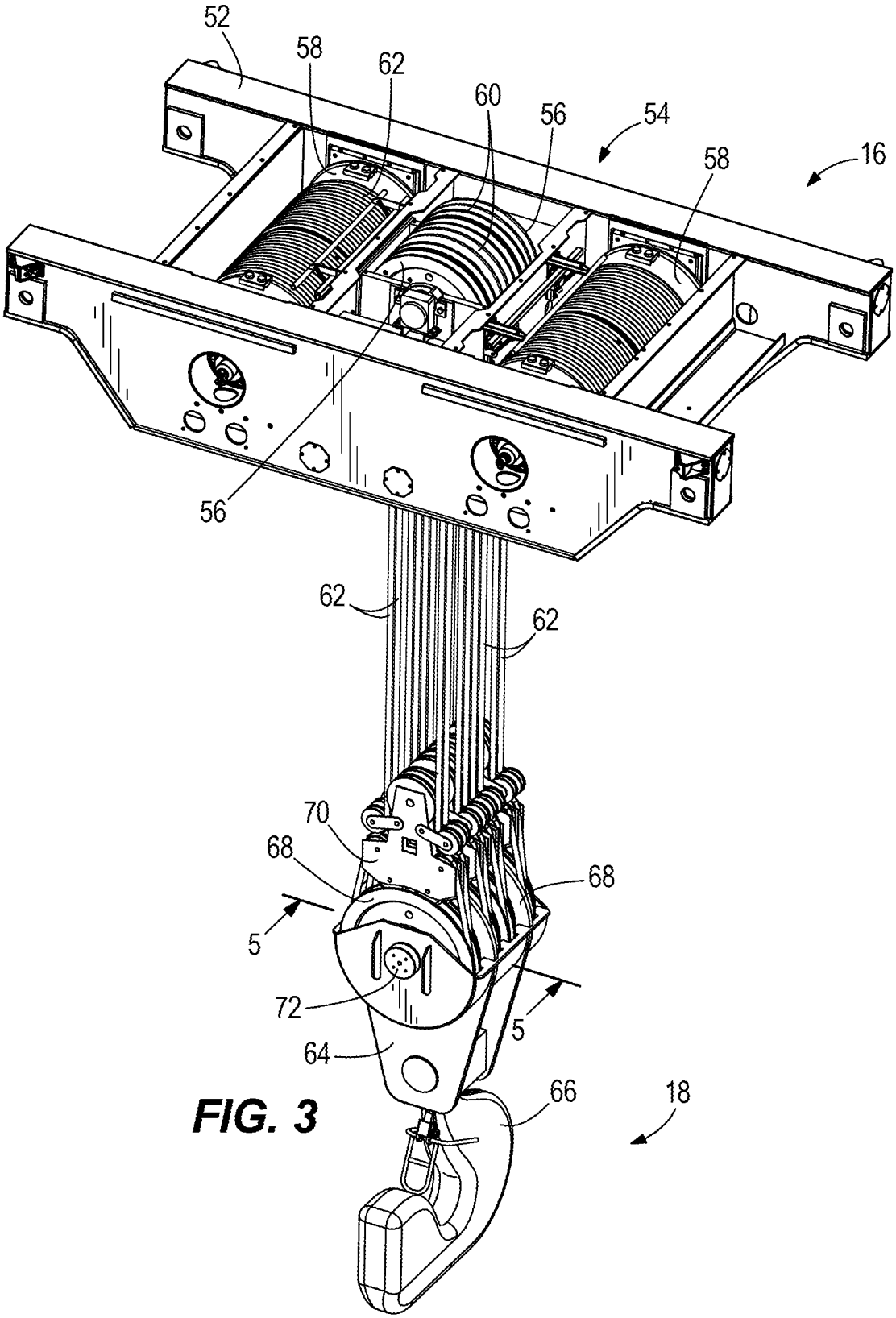
FIG. 3 is a perspective view of an upper beam assembly with the bottom block assembly in the second, deployed position.
Figure 4:
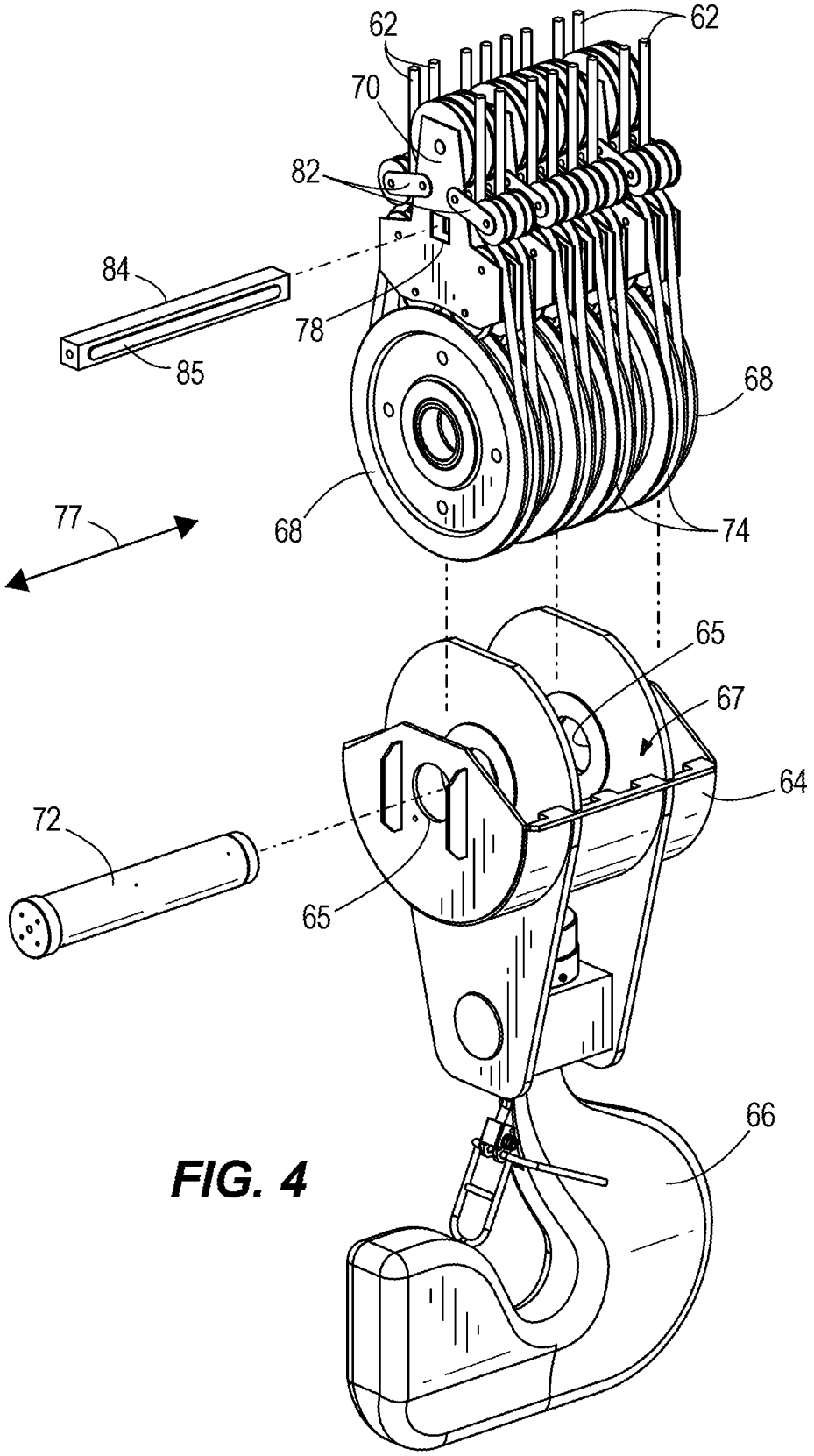
FIG. 4 is an exploded perspective view of the bottom block assembly.

With reference to FIGS. 3 and 4, the bottom block assembly 18 is shown in an intermediate position between the retracted position and the extended position with respect to the upper beam assembly 16. The upper beam assembly 16 includes a frame 52 that houses a pulley system 54. The pulley system 54 includes a plurality of upper sheaves 56 and a pair of winch drums 58. The upper sheaves 56 are generally centrally located within the upper beam assembly 16 and each include a grooved portion 60 that receives a wire 62 (e.g., in the form of cable, wire rope, chain, or any other flexible structure configured to be guided by the grooved portions 60). The winch drums 58 are disposed on either side of the upper sheaves 56. The winch drums 58 store and feed the wires 62 to the upper sheaves 56. The wires 62 extend around the upper sheaves 56 in the upper beam assembly 16 and are connected to the bottom block assembly 18. When the winch drums 58 rotate, the wires 62 are either drawn up into the upper beam assembly 16 or are deployed from the upper beam assembly 16. Therefore, by rotating the winch drums 58, the bottom block assembly 18 is moved between the retracted and extended positions.

With continued reference to FIGS. 3 and 4, the bottom block assembly 18 is reeved to be single failure proof per ASME NOG-1-2004. The bottom block assembly 18 includes a bottom block 64 having a plurality of apertures 65, a hook assembly 66 supported by the bottom block 64, a cavity 67, a plurality of lower sheaves 68 partially disposed within the cavity 67 of the bottom block 64, a plurality of captivating frame assemblies 70, and a sheave pin 72. The sheave pin 72 connects the bottom block 64 and the plurality of lower sheaves 68 and allows the lower sheaves 68 to rotate relative to the bottom block 64. There are a total of eight lower sheaves 68, each having a grooved portion 74, though in other constructions a different number of sheaves 68 are used.

The wires 62 reeved around the upper sheaves 56 extend downward, reeve through the captivating frame assemblies 70, around the lower sheaves 68, and extend back upward toward the upper beam assembly 16, thereby creating the pulley system 54. Because each captivating frame assembly 70 is identical to the adjacent captivating frame assemblies 70, only one of the captivating frame assemblies 70 will be discussed in detail even though the discussion applies to the remaining captivating frame assemblies 70 as well.

Figure 5:
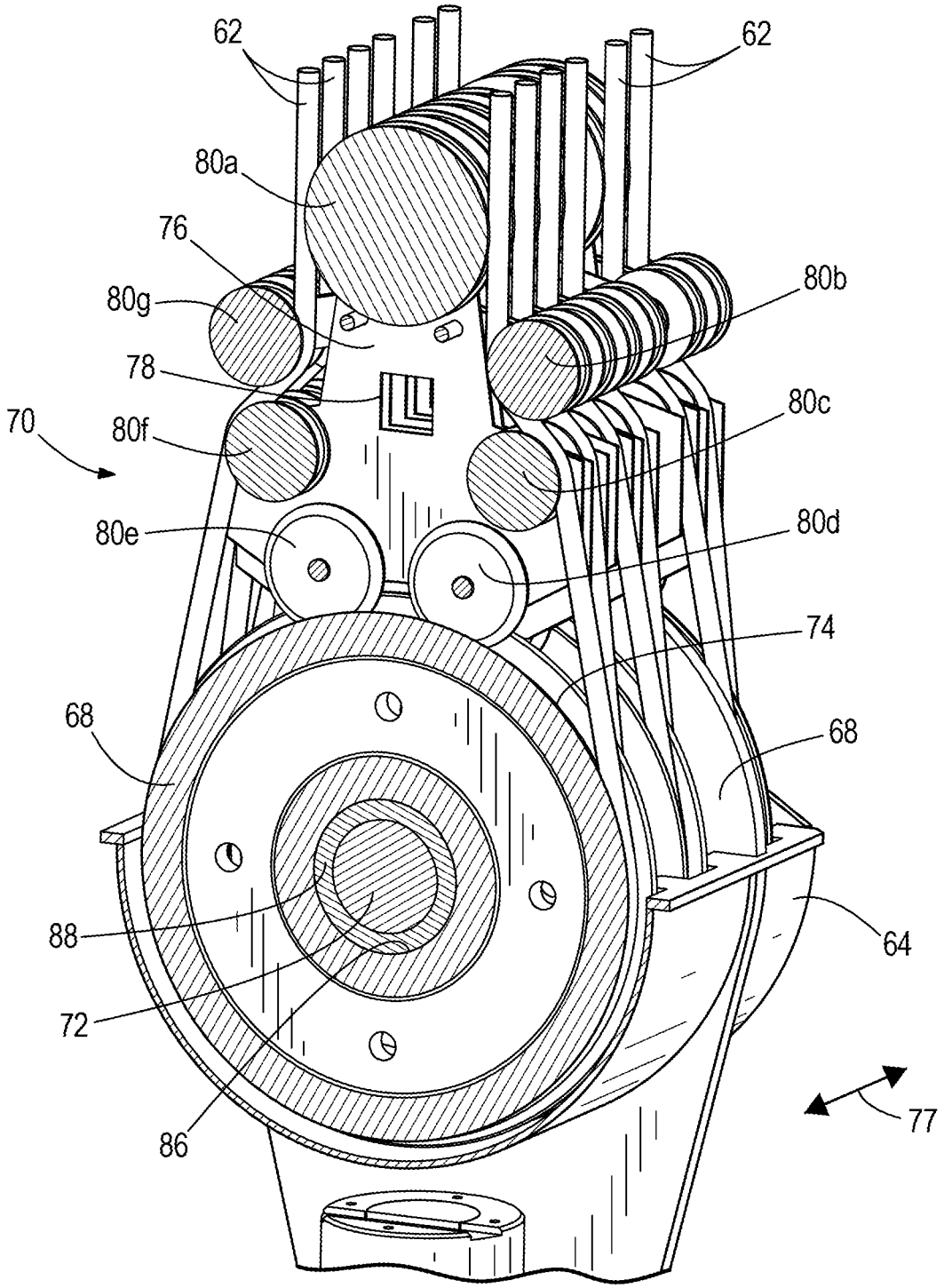
FIG. 5 is a cross-sectional view of the bottom block assembly along line 5-5 of FIG. 3.

With reference to FIG. 5, the captivating frame assembly 70 includes a housing 76, a key slot 78 extending through the housing 76, and a plurality of sheave rollers 80*a-g*. The sheave rollers 80*a-g* are supported for rotation on the housing 76. The rollers 80*a*, 80*b*, 80*c*, 80*f*, 80*g* receive and guide the wires 62 towards the lower sheave 68, whereas the rollers 80*d* and 80*e* interface (i.e., are disposed at least partially within) with the grooved portion 74 of the corresponding lower sheave 68. The rollers 80*d* and 80*e* physically contact the lower sheave 68 within the grooved portion 74 to inhibit relative movement in a lateral direction 77 between the captivating frame assembly 70 and the corresponding lower sheave 68. The wires 62 tangentially contact each of the rollers 80*a*, 80*b*, 80*c*, 80*f*, 80*g*. Moreover, the rollers 80*b*, 80*g* are moveable along an arcuate path relative to the captivating frame assembly 70 via two biasing arms 82 (FIG. 4). One biasing arm 82 is coupled to the roller 80*b*, while the other biasing arm 82 is coupled to the roller 80*g*. The biasing arms 82 bias the corresponding rollers 80*b*, 80*f* into engagement with the wire 62.

With continued reference to FIG. 5, the key slot 78 of the illustrated embodiment is a rectangular-shaped aperture, although in other embodiments, the key slot 78 may be alternatively shaped as a square, hexagon, triangle, or other like shape. The key slot 78 of each captivating frame assembly 70 receives a key rod 84 for coupling the captivating frame assemblies 70 together. The key rod 84 of the illustrated embodiment has rectangular-shaped cross section corresponding the rectangular-shaped aperture of the key slot 78. In other embodiments, the key rod 84 could alternatively be square, triangular, or other like shapes. Once the key rod 84 is inserted into each key slot 78, each captivating frame assembly 70 is inhibited from moving relative to an adjacent captivating frame assembly 70 since the key rod 84 effectively locks each individual captivating frame assembly 70 together. In other words, the captivating frame assemblies 70 move as a single unit when the key rod 84 is inserted therein such that the key rod 84 inhibits any pitch, roll, or yaw of adjacent captivating frame assemblies 70 as a result of the key rod 84 being received by each captivating frame assembly 70. With the captivating frame assemblies 70 moving as a single unit, the lower sheaves 68 and the wires 62 are also inhibited from twisting and rotating (e.g., spinning) relative to each other, which may otherwise naturally occur when the sheaves are lifted out of the bottom block 64. The key rod 84 is selectively removable from the key slot 78 to perform maintenance on the bottom block assembly 18. In some embodiments, the key rod 84 includes a friction surface 85 (FIG. 7) disposed on one or more of the faces of the key rod 84 to facilitate (or in other embodiments inhibit) easy removal of the key rod 84 from the key slot 78. When the key rod 84 is removed from the key slot 78, the captivating frame assemblies 70 are capable of moving relative to each other, as described in more detail below.

Because each lower sheave 68 is identical, only one of the lower sheaves 68 will be discussed in detail even though the discussion applies to the remaining lower sheaves 68 as well. The lower sheave 68 includes the grooved portion 74 that receives the wire 62, a bearing opening or an aperture 86 centrally located within the lower sheave 68, and a bearing 88 that is received by the aperture 86 and rotatably supports the lower sheave 68 on the sheave pin 72. The bearing 88 of the illustrated embodiment is a standard ball-type bearing or roller-type bearing, while in other embodiments, the bearing 88 may alternatively be a plain bearing, a dry bushing bearing, or other similar type bearing.

Figure 6:
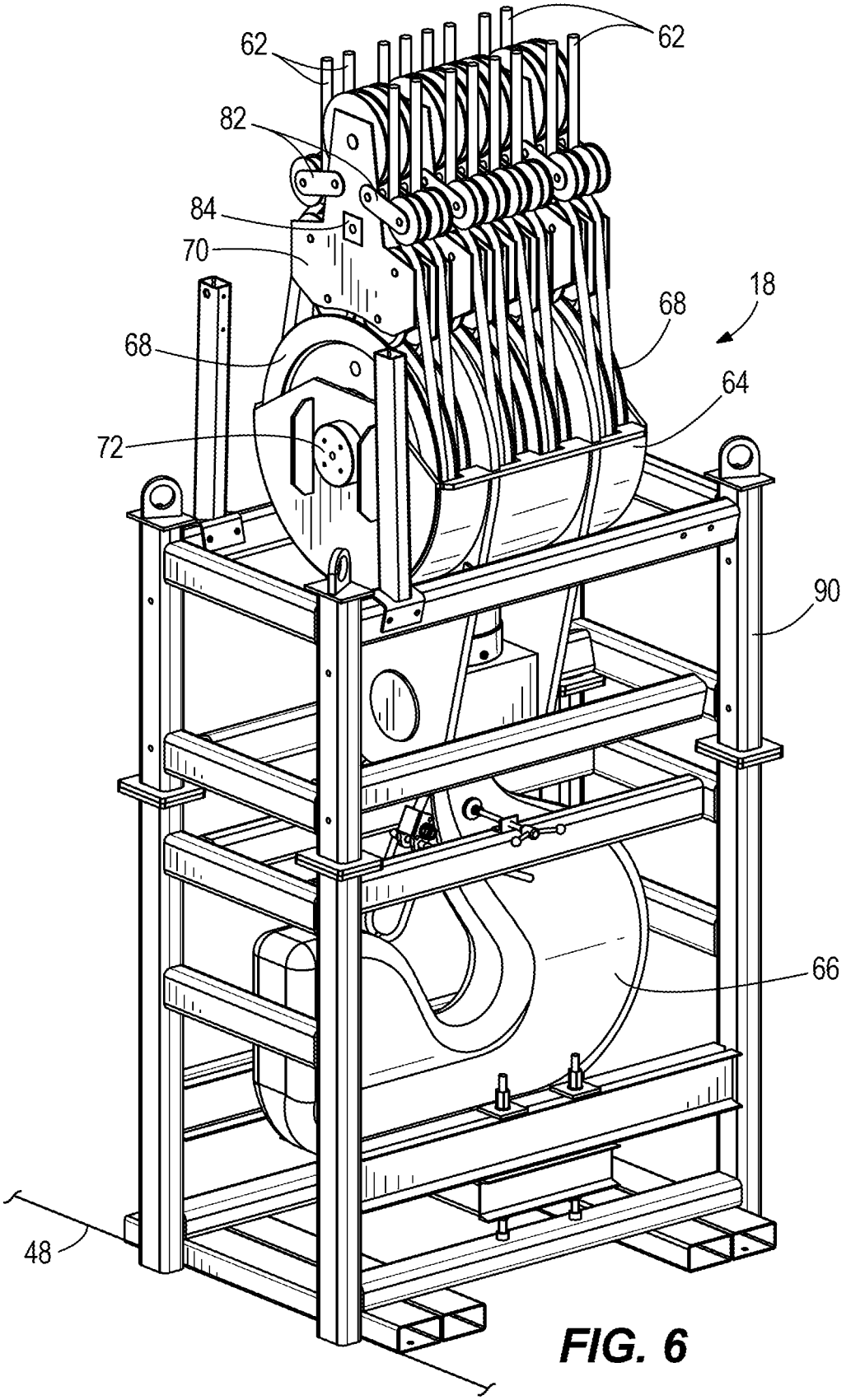
FIG. 6 is a perspective view of the bottom block assembly being supported by a support stand.
Figure 7:
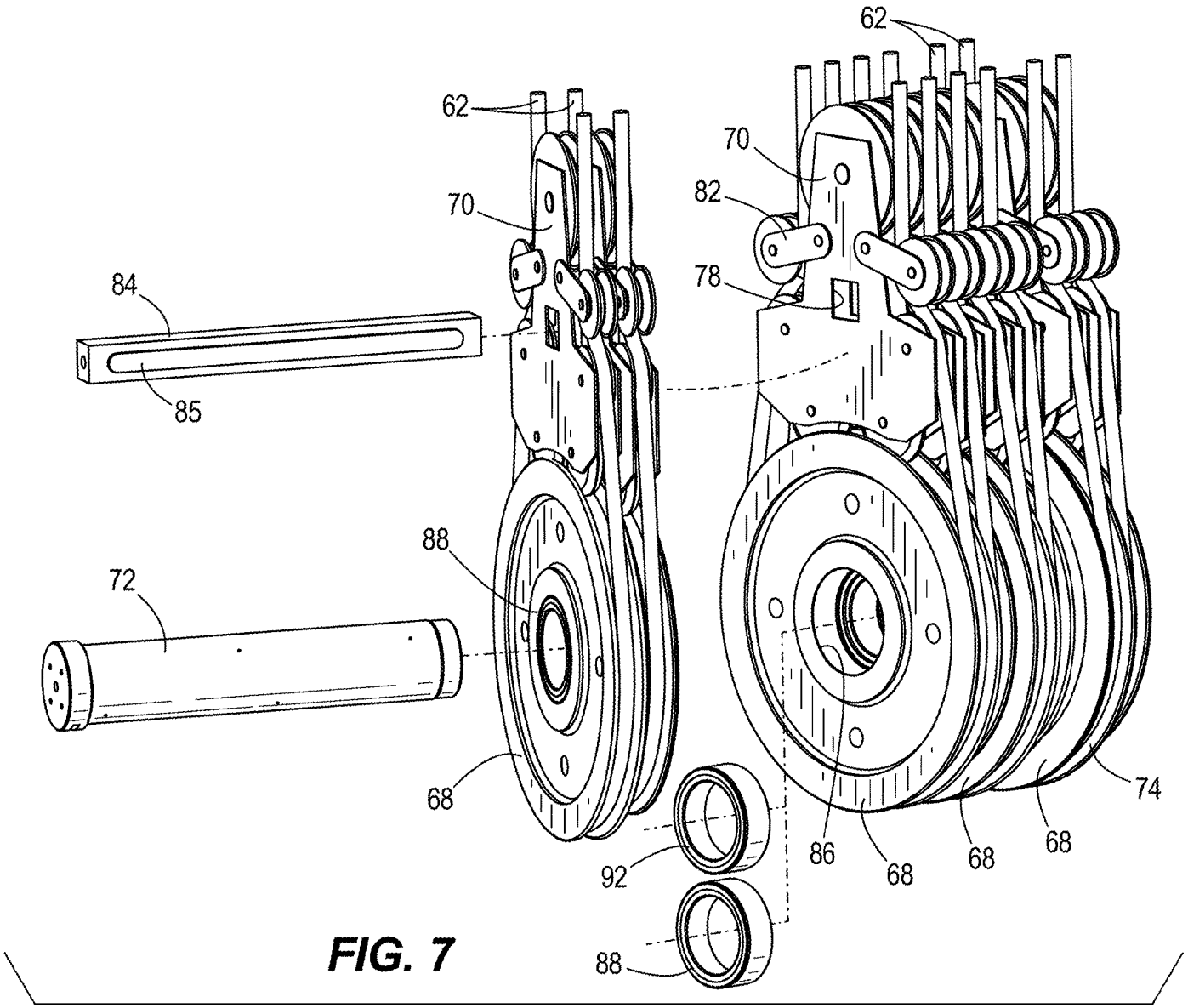
FIG. 7 is a perspective view of the bottom block assembly in a partially disassembled state during maintenance.

With reference to FIGS. 6-7, a method of performing maintenance on the bottom block assembly 18 is illustrated. In the situation where a component of the bottom block assembly 18 is required to be fixed or replaced, the method includes lowering the bottom block assembly 18 toward the extended position until the bottom block assembly 18 is supported within a support stand 90. The support stand 90 is, in turn, supported on the ground surface 48. Some of the components that require relatively frequent replacement are the bearings 88 of the bottom block assembly 18.

With reference to FIG. 7, the sheave pin 72 is removed from the bottom block assembly 18 while the bottom block assembly 18 is being supported by the support stand 90 (FIG. 6). The pulley system 54 subsequently raises the plurality of lower sheaves 68 and captivating frame assemblies 70 (without the bottom block 64) from the support stand 90 to allow for clearance between the lower sheaves 68 and the bottom block 64 (FIG. 4). At this point, the plurality of captivating frame assemblies 70 and lower sheaves 68 are still coupled together via the key rod 84, while having been removed from the bottom block 64. Once the lower sheaves 68 have been lifted and it is desired to perform inspection or maintenance, the key rod 84 may then be removed from the key slot 78, and each captivating frame assembly 70 and its corresponding lower sheave 68 is allowed to be moved relative to adjacent captivating frame assemblies 70 and lower sheaves 68, as illustrated in FIG. 7. At this stage a maintenance person is able to gain access to any one of the bearings 88 of the lower sheaves 68 while the wires 62 are still reeved through the captivating frame assembly 70 and around the lower sheave 68. The maintenance person can simply separate or swing any number of captivating frame assemblies 70 and lower sheaves 68 (two are swung away in the case of FIG. 7) away from the remaining captivating frame assemblies 70 and lower sheaves 68 to remove the bearing 88 from the aperture 86 of the lower sheave 68 and insert a new similar bearing 92 into the aperture 86. The bearing 88 that was removed may subsequently be disposed of, repaired, or recycled. During this time, the maintenance person may also unreeve one or more of the wires 62 of the pulley system 54 from the corresponding captivating frame assembly 70 and the sheave 68 to allow a new wire to be reeved through the corresponding captivating frame assembly 70 and around the sheave 68, if desired.

To reassemble the bottom block assembly 18 after performing maintenance, the captivating frame assemblies 70 and the lower sheaves 68 are once again moved into contact with each other so the key rod 84 can be inserted into the key slot 78 of each captivating frame assembly 70, thereby coupling all of the captivating frame assemblies 70 together. The pulley system 54 subsequently lowers the plurality of lower sheaves 68 and captivating frame assemblies 70 until the lower sheaves 68 are resting in the cavity 67 of the bottom block 64. The sheave pin 72 is then reinserted to recouple the lower sheaves 68 to the bottom block 64.

In some embodiments, the bottom block assembly 18 reduces the amount of time and labor typically involved with replacing components, namely the bearings 88 of the bottom block assembly 18.

Figure 8:
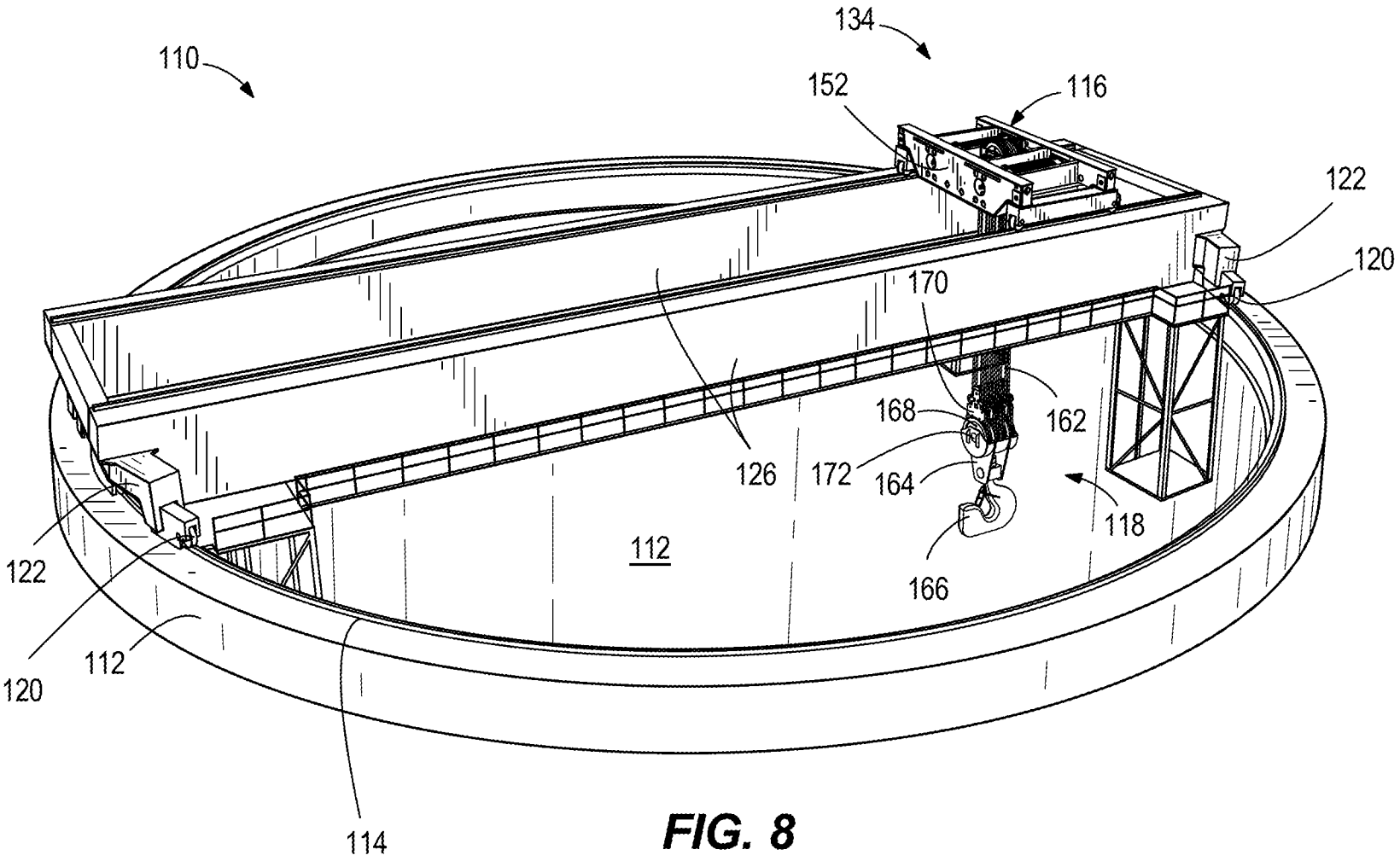
FIG. 8 is a perspective view of a crane assembly, illustrating a bottom block assembly in a first, retracted position.

FIG. 8 illustrates crane assembly 110 (e.g., a polar crane assembly). A bottom block assembly 118 is supported by the crane assembly 110. The crane assembly 110 includes a 360 degree runway 114 surrounding a nuclear pit 112, a pair of girders 126 extending along a the diameter of the pit 112, a plurality of end trucks 122 (only two of which are shown) pivotably supported by the girders 126, and a trolley 134 for moving the bottom block assembly 118 relative to the girders 126. Each end truck 122 includes wheels 120 for allowing the girders 126 to travel along the runway 114. The trolley 134 is movably coupled to the girders 126 and includes an upper beam assembly 116 (similar to the one shown in FIG. 3), which supports the bottom block assembly 118 for vertical movement. The upper beam assembly 116 includes a frame 152 that houses a pulley system 54 (see FIG. 3).

With reference to FIG. 8, the bottom block assembly 118 is reeved to be single failure proof per ASME NOG-1-2004. The bottom block assembly 118 is identical to the bottom block assembly 18 (FIG. 4), and therefore includes a bottom block 164 (identical to the bottom block 64) having a plurality of apertures, a hook assembly 166 (identical to hook assembly 66) supported by the bottom block 164, a cavity, a plurality of lower sheaves 168 (identical to the lower sheaves 68) partially disposed within the cavity of the bottom block 164, a plurality of captivating frame assemblies 170 (identical to the frame assemblies 70), and a sheave pin 172 (identical to the pin 72). The sheave pin 172 connects the bottom block 164 and the plurality of lower sheaves 168 and allows the lower sheaves 168 to rotate relative to the bottom block 164. Wires 162, which are reeved around the upper sheaves 56 extend downward, reeve through the captivating frame assemblies 170, around the lower sheaves 168, and extend back upward toward the upper beam assembly 116.

During operation, the bottom block assembly 118 is capable of accessing various locations within the nuclear pit 112. Specifically, the trolley 134 includes its own drive system that allows the trolley 134 (to which the bottom block assembly 118 is connected) to traverse the length of the girders 126. Likewise, the end trucks 122 include their own drive system(s) that allow the girders 126 to rotate 360 degrees around the runway 114. As such, the bottom block assembly 118 is capable of accessing various locations within the nuclear pit 112 through a combination of linear and arcuate movement relative to the pit 112. Additionally, the bottom block assembly 118 is movable between the retracted or "raised" position and an extended or "lowered" position. While a single bottom block assembly 118 is illustrated, in other constructions, multiple bottom block assemblies (e.g., a main and an auxiliary) may be used to access and hoist different components.

Although the invention has been described in detail with reference to certain preferred constructions, variations and modifications exist within the scope and spirit of one or more independent aspects of the invention as described.

What is claimed is:

1. A bottom block assembly comprising:

a bottom block defining a cavity and at least one opening passing through a portion of the bottom block;

a plurality of sheaves disposed at least partially within the cavity, each sheave having a central opening;

a sheave pin passing through the at least one opening in the bottom block and the central openings in the sheaves to rotatably couple the plurality of sheaves to the bottom block;

a plurality of captivating frame assemblies, each of the plurality of captivating frame assemblies including a housing and a plurality of rollers rotatably mounted to the housing, wherein each captivating frame assembly is coupled with a corresponding one of the sheaves; and a plurality of wires, wherein each captivating frame assembly is linked to the corresponding one of the sheaves by one of the plurality of wires, and further wherein each wire is reeved around one of the sheaves and reeved through the corresponding captivating frame assembly.

2. The bottom block assembly of claim 1, wherein each captivating frame assembly is a separate, individual assembly from each of the other captivating frame assemblies.

3. The bottom block assembly of claim 1, wherein the housing of each captivating frame assembly includes a key slot extending through the housing.

4. The bottom block assembly of claim 3, further comprising a key rod selectively received through each key slot of the plurality of captivating frame assemblies.

5. The bottom block assembly of claim 4, wherein the key rod includes a rectangular cross-section.

6. The bottom block assembly of claim 4, wherein the plurality of captivating frame assemblies are coupled together and are movable in unison with each other when the key rod is received within the key slot of each captivating frame assembly.

7. The bottom block assembly of claim 6, wherein the plurality of captivating frame assemblies are movable relative to each other when the key rod is removed from the key slot of each captivating frame assembly.

8. The bottom block assembly of claim 1, wherein each sheave is a separate, individual component from each of the other sheaves.

9. The bottom block assembly of claim 8, wherein the sheave pin couples the plurality of sheaves together when the sheave pin is coupled to the bottom block, and wherein the plurality of sheaves are movable relative to each other and relative to the bottom block when the sheave pin is removed from the bottom block.

10. The bottom block assembly of claim 1, wherein the plurality of rollers include two sheave rollers that are rotatably engaged with the corresponding sheave and five wire rollers that are rotatably engaged with the corresponding wire.

11. The bottom block assembly of claim 10, wherein each captivating frame assembly further includes two biasing arms, wherein one biasing arm is coupled one of the wire rollers and the other biasing arm is coupled to another one of the wire rollers, and wherein the biasing arms bias the corresponding wire rollers into engagement with the wire.

12. The bottom block assembly of claim 1, wherein the plurality of wires are reeved to be a single failure proof assembly.

13. The bottom block assembly of claim 1, wherein a separate bearing is disposed within the central opening of each of the sheaves, each bearing having a bearing opening that is coaxial with the at least one opening of the bottom block.

14. A bottom block assembly comprising:

a plurality of sheaves;

a plurality of captivating frame assemblies, each of the plurality of captivating frame assemblies including a housing and a roller, wherein each captivating frame assembly is coupled with a corresponding sheave; and a plurality of wires, wherein each captivating frame assembly is linked to the corresponding sheave by one of the plurality of wires, wherein each wire is reeved around one of the sheaves and reeved through the corresponding captivating frame assembly, wherein each of the rollers is rotatably engaged with one of the wires, and wherein each captivating frame assembly further includes a biasing arm coupled to the housing and the roller and configured to bias the roller into engagement with the wire.

15. The bottom block assembly of claim 14, wherein each captivating frame assembly is a separate, individual assembly from each of the other captivating frame assemblies.

16. The bottom block assembly of claim 14, wherein the housing of each captivating frame assembly includes a key slot extending through the housing.

17. The bottom block assembly of claim 16, further including a key rod inserted through each key slot to couple the plurality of captivating frame assemblies together.

18. The bottom block assembly of claim 17, wherein each captivating frame assembly and each corresponding sheave are separable from adjacent captivating frame assemblies and corresponding sheaves when the key rod is removed from each key slot, thereby uncoupling the bottom block assembly.

19. The bottom block assembly of claim 17, wherein the key rod includes a rectangular cross-section.

20. The bottom block assembly of claim 14, wherein the roller is a first roller, wherein each captivating frame assembly further includes a second roller coupled to the housing and rotatably engaged with the corresponding sheave.

* * * * *